US009493260B2

(12) United States Patent
Koch et al.

(10) Patent No.: US 9,493,260 B2
(45) Date of Patent: Nov. 15, 2016

(54) APPARATUS AND METHOD FOR PACKAGING ARTICLES

(75) Inventors: Peter Koch, Seeon (DE); Thomas Wimmer, Rosenheim (DE)

(73) Assignee: Krones AG, Neutraubling (DE)

( * ) Notice: Subject to any disclaimer, the term of this patent is extended or adjusted under 35 U.S.C. 154(b) by 610 days.

(21) Appl. No.: 13/582,849

(22) PCT Filed: Feb. 14, 2011

(86) PCT No.: PCT/EP2011/052102

§ 371 (c)(1),
(2), (4) Date: Sep. 5, 2012

(87) PCT Pub. No.: WO2011/110401

PCT Pub. Date: Sep. 15, 2011

(65) Prior Publication Data

US 2012/0324833 A1 Dec. 27, 2012

(30) Foreign Application Priority Data

Mar. 9, 2010 (DE) ..... 10 2010 015 865

(51) Int. Cl.

| | |
|---|---|
| ***B65B 1/02*** | (2006.01) |
| ***B65B 49/12*** | (2006.01) |
| ***B65B 5/02*** | (2006.01) |
| ***B65B 7/20*** | (2006.01) |
| ***B65B 21/24*** | (2006.01) |

(52) U.S. Cl.

CPC ..... *B65B 49/12* (2013.01); *B65B 5/024* (2013.01); *B65B 7/20* (2013.01); *B65B 21/24* (2013.01)

(58) Field of Classification Search

None

See application file for complete search history.

(56) References Cited

U.S. PATENT DOCUMENTS

| | | | | |
|---|---|---|---|---|
| 2,832,182 | A | 8/1956 | McGihon | |
| 3,058,271 | A * | 10/1962 | McGihon | B65B 5/024 493/309 |
| 3,406,493 | A | 10/1968 | Katogir | |
| 3,714,757 | A * | 2/1973 | Feigel | B65B 7/20 53/377.2 |
| 3,965,645 | A | 6/1976 | Ganz | |
| 4,121,506 | A * | 10/1978 | Van Grouw | B31B 1/36 493/131 |
| 4,203,272 | A * | 5/1980 | Minery | B65D 85/327 493/136 |
| 4,206,579 | A * | 6/1980 | Woxland | B65B 43/39 493/180 |

(Continued)

FOREIGN PATENT DOCUMENTS

| | | |
|---|---|---|
| CH | 432 339 | 3/1967 |
| CN | 1648004 | 8/2005 |
| CN | 101312882 | 11/2008 |
| DE | 15 86 181 | 7/1970 |
| DE | 697 27 898 T2 | 3/2005 |

(Continued)

*Primary Examiner* — Hemant M Desai
*Assistant Examiner* — Tanzim Imam
(74) *Attorney, Agent, or Firm* — Davidson, Davidson & Kappel, LLC

(57) ABSTRACT

An apparatus for packaging articles in a box blank which has folding lines and also side flaps and/or lid flaps and/or base flaps. The apparatus includes a device for feeding a stream of articles, a device for dividing up the articles into groups and/or assemblies of articles, a device for feeding individual box blanks to the groups of articles and/or for combining the groups of articles and the box blanks, and a device for forming a box and for folding in the side flaps by folding-in elements, which rotate about an axis which is more or less perpendicular to the conveying plane and/or conveying direction of the box blanks. The folding-in elements each have at least one pair of folding-in devices, which can be moved in a common plane and which can be moved and/or controlled and regulated independently of one another.
A method and a folding element is also provided.

18 Claims, 4 Drawing Sheets

(56) References Cited

U.S. PATENT DOCUMENTS

| | | | | |
|---|---|---|---|---|
| 5,063,726 | A | 11/1991 | Boisseau | 53/491 |
| 5,066,269 | A * | 11/1991 | Center | B31B 3/00 493/183 |
| 6,381,923 | B1 | 5/2002 | Plueschow et al. | |
| 2005/0279057 | A1 | 12/2005 | Tale' et al. | |
| 2009/0139185 | A1 | 6/2009 | Gorrieri et al. | |

FOREIGN PATENT DOCUMENTS

| | | | |
|---|---|---|---|
| DE | 20 2005 014 345 | U1 | 1/2007 |
| EP | 0849176 | | 3/2004 |
| EP | 1 471 006 | B1 | 10/2004 |
| EP | 1471006 | A2 * | 10/2004 |
| JP | 2003 094 533 | | 4/2003 |
| JP | 2006 082 853 | | 3/2006 |

* cited by examiner

APPARATUS AND METHOD FOR PACKAGING ARTICLES

The present invention relates to an apparatus for packaging articles in a box blank provided with folding. The invention furthermore relates to a corresponding packaging method.

BACKGROUND

Such an apparatus is for instance known from EP 1 471 006 B1. The packaging machine disclosed in detail there is intended for wrapping a group of articles, consisting for instance of bottles, in a box blank having folding lines, and it comprises a package forming unit which starts with completely enveloping the group of articles that is placed on the box blank by the four the lateral surfaces of the box blank. The side flaps, which are aligned flush lengthwise in the conveying direction of the bundle groups and the box blanks, are folded in at right angles to the conveyor track, just like the base and/or lid flaps in the subsequent work steps. The side flap closers, which are clearly recognizable in the FIGS. 24 to 26, are provided for this purpose. These are two rotating, prong-like elements, which are arranged at both sides of the package conveyor at more or less the same height in relation to the conveying direction and which rotate in a plane that is parallel to the conveying plane, whereby these elements are coupled with the driving motor for the package conveyor by means of mechanical drive elements in order to allow precision-adjusted synchronization of the rotation in relation to the feeding movement of the packages. These elements are designed to fold in both the downstream and the upstream side flaps at the front or back ends of the passing boxes by 90 degrees. In order to be able to process boxes of different-sized formats, the disc-like side flap closers are designed to have two parts, whereby both parts can be manually twisted relative to each other for the purpose of format adaptation.

A similar apparatus for packaging containers using cartons made from box blanks is furthermore known from DE 697 27 898 T2.

An apparatus for producing, filling, and sealing packages and blanks made of cardboard is also known from CH 432 339 A. This known apparatus comprises conveying members and glue-application members for flat-lying box blanks as well as a folding station with a folding channel through which the blank is passed by means of a receiving die, which picks up the objects for packaging and pushes them into an extension of the folding channel by forming a U-shaped wrap and folding in the base flaps by means of folding tools. The folding tools consist of two folding members arranged mirror-symmetrically and pivotably on both sides of the package, whereby said folding members are integrated with an apparatus for discharging the package. Each of the folding members consists of two folding switches disposed in a staggered relation to each other, and it is provided with a feed roll. The folding switch adjacent to the swivel axis serves for turning over the two front side base flaps. The folding switch arranged at a greater distance serves for folding in the longitudinal base flap, while the feed roll arranged on the folding switch serves for discharging the package and simultaneously folding over the end flap.

Another apparatus for packaging articles is disclosed in DE 20 2005 014 345 U1. Instead of prong- or disc-like elements for folding in the side flaps, this known apparatus employs folding-in elements designed like rod-shaped fingers, which are arranged in movement direction offset at more or less right angles in relation to one another. The angle enclosed by the two fingers can, in particular, be exactly 90 degrees.

The folding-in apparatuses known from prior art require manual adjustments and resetting operations in the instance of changing the dimensions of the articles and/or boxes to be folded in. Further problems can arise from the relatively complex curve that the folding-in apparatuses have to trace in order to be able to fold two consecutive boxes that are being fed at nearly the same time. In addition, the spaces between the boxes can vary according to the pitch of the main conveyor chains. Very small chain pitches in the direction of movement together with very long boxes result in relatively small spaces and therefore only very short time slots for folding in the flaps. Kinematic limits may repeatedly ensue.

SUMMARY OF THE INVENTION

It is an object of the present invention is to provide, by contrast, an improved apparatus for folding in box blanks, whereby said apparatus can be smoothly and quickly adapted to different sizes of articles and boxes as well as to different pitch distances of the box blanks intended for folding-in. Furthermore, another objective of the invention is to provide an improved method for folding-in box blanks, whereby said method allows smooth and quick adaptation to different article and box sizes as well as to different pitch distances of the box blanks intended for folding-in.

It is proposed to no longer employ merely a single-motored flap folding-in means in combination with one dual finger member for folding in the box flaps, but rather a more flexible apparatus with more than one finger member, these fingers moreover, according to the present invention, not only being adjustable in relation to each other but also rotatable independently from one another.

The present invention provides an apparatus for packaging articles in a box blank which has folding lines and also side flaps and/or lid flaps and/or base flaps. This apparatus according to the invention comprises at least one device for feeding a stream of articles, a device for dividing up the articles into so-called groups of articles and/or assemblies of articles, a device for feeding individual box blanks to the groups of articles and/or for combining the box blanks and the groups of articles, and a device for forming a box by folding the box blank. Furthermore, a device for folding in the side flaps by means of folding-in elements is provided, said elements rotating about an axis which is more or less perpendicular to the conveying plane or to the conveying direction of the box blanks and each of the said folding-in elements having at least one pair of folding-in means, which can be moved in a common, in particular in a more or less horizontal, plane. According to the present invention, the two folding-in means can be moved and/or controlled and regulated independently of one another. It is furthermore possible for the two folding-in means to be aligned in each case pairwise and more or less in perpendicular to a vertical plane and arranged in the movement direction in positions shifted in relation to each other and movable about a common rotational axis.

Besides the mentioned arrangement for the folding-in elements or folding-in means, almost any spatial arrangement is possible as long as the tasks that are essential to the invention are carried out, namely bending over and folding in the box flaps of a box blank or of an already formed box. The folding-in means can therefore optionally be used for folding in the side flaps of the box. They can, however, also be used for folding in the base and/or lid flaps. In order to bend over or fold in the side flaps of a box that is being advanced on a horizontal conveyor belt, it is expedient to employ an arrangement comprising vertical pivoting axes for the folding-in means, the plane of movement of which is therefore arranged such as to be nearly horizontal. Of course, such an arrangement is not to be understood as restrictive; other configurations with horizontal pivoting axes for the folding-in elements, where the folding-in means can move in vertically disposed planes, are also conceivable in order to bend over and fold in base flaps and/or lid flaps. Furthermore, it is also generally conceivable to arrange the drive shafts of the folding-in elements in a slanted position, as the case may be, so that the said folding-in elements can also be pivoted in a slanted plane or in a plane inclined in relation to the transport direction of the article stream.

In the context of the present invention, the terms "folding-in means" and "pairs of folding-in means" refer to folding-in means that are preferably each disposed on both sides of the article stream and each designed as rod-shaped fingers, for instance. Other forms or outlines are, however, also possible, for instance folding-in means in the shape of sheet metal strips, spheres, or bow-shaped members or the like, which are, in each case, suitable for fulfilling the intended purpose, namely folding the flaps of the box. Optionally, these folding-in means, fingers, bow-shaped members, or the like, can be designed in different lengths or forms, or be, for instance, designed to be adjustable.

The folding-in means or rod-shaped fingers can optionally be aligned in each case pairwise and more or less in perpendicular to a vertical plane and arranged in the movement direction in positions shifted in relation to each other and movable about rotational axes that are each disposed in parallel to each other with only a small distance between the axes. As mentioned above, other spatial arrangements are also conceivable for the folding-in means or the folding-in fingers.

According to another particular embodiment variant, the apparatus according to the invention serves for packaging articles in a box blank which has folding lines and also side flaps and/or lid flaps and/or base flaps. The apparatus comprises a device for feeding a stream of articles, a device for dividing up the articles into groups of articles, and a device for feeding individual box blanks in conveying direction to the groups of articles and/or for combining the groups of articles and the box blanks. The box blanks are transported, for instance, in a continuous row from below to a position underneath the groups of articles in such a manner that the side flaps point lengthwise in the conveying direction. It is, however, optionally possible to feed the box blanks from other directions. The apparatus can moreover comprise a device for forming a box and for folding in the side flaps transversely to the conveying direction by means of folding-in elements, which, for instance, rotate about an axis that is perpendicular to the conveying plane of the box blanks. The folding-in elements are formed as rod-shaped fingers or differently formed folding-in means and they are aligned in each case pairwise and more or less in perpendicular to the vertical axis so that they are moveable approximately horizontally in this variant. Furthermore, they are arranged shifted in relation to each other, with a first finger folding in the side flap at the rear end of the box ahead and a second finger folding in the front side flap of the subsequent box. The two fingers are moveable in relation to each other, which implies that they can perform rotary movements which are essentially independent of one another. Whereas the folding-in elements known from prior art could only be adjusted with regard to the angular position of the fingers in relation to each other and fixed in the selected positions in order to be able to perform the necessary rotating or pivoting movements, the present invention makes provisions for decoupling the rotating or pivoting movements of at least two of the folding-in fingers, thus enabling smooth adjustments to different box sizes and pitch distances. The invention can, in particular, be employed for folding in box flaps in a continuous conveying process in a packaging machine. According to the idea of the invention, this involves moving two separate fingers, which can be moved, for instance, about a common axis of rotation or by means of a combined, multi-part shaft.

According to an advantageous embodiment variant of the invention, the rod-shaped fingers are aligned in each case pairwise and more or less in perpendicular to a vertical plane and arranged in the movement direction in positions shifted in relation to each other and movable about a common rotational axis. This can be realized, for instance, by way of a multi-part hollow shaft with shaft sections arranged coaxially in relation to each other and fingers disposed on each. The rod-shaped fingers can optionally be aligned in each case pairwise and more or less in perpendicular to a vertical plane and arranged in the movement direction in positions shifted in relation to each other and movable about rotational axes that are each disposed in parallel to each other with only a small distance between the axes. In this variant of the apparatus according to the invention, it is possible, for instance, for two parallel shafts to be arranged next to each other.

Preferably, each of the shafts on which the fingers are in each case pivotably arranged, has a drive of its own so that the shafts and the fingers arranged thereon can each perform rotational movements independently of one another.

One embodiment variant of the apparatus according to the invention provides for the two shafts with their respectively allocated, separate drives to be designed as coaxial inner and outer shafts. Optionally, the two shafts with their respectively allocated, separate drives can be arranged one above the other, in each case aligned largely flush with each other. In addition, the two shafts with their respectively allocated, separate drives can also be each arranged one above the other with parallel axes of rotation, said axes, however, shifted in relation to each other.

Furthermore, it is possible to provide the finger-like folding-in elements in variable and/or adjustable lengths. In this manner, it is even better possible to set and adjust the apparatus to different box and/or article sizes and different pitch distances.

The shaft drive can be performed in a number of different ways. The shafts can be driven by means of separate electric motors. The shafts, together with the fingers arranged thereon, can also be directly coupled with the driving motors by means of chain drives or belt drives. A particularly useful variant of the present invention is to provide one of the two shafts with a direct drive, while the other shaft has a belt drive. In the instance of the two-part hollow shaft arrangement, the inner shaft may comprise a direct drive, while the hollow shaft is coupled to a driving motor, which is disposed offset, by means of a belt or chain drive. This is possible to assemble, for instance, by means of a hollow shaft, which can be separately driven by a belt and a second motor. The solid shaft is preferably arranged directly on the first motor.

Typically, in each case two pairs of finger-like folding-in elements, which are each movable independently of one another, are arranged on both sides of the article stream, the said elements used for folding in the side flaps of the box blanks transversely to the conveying direction. The essential improvement over the heretofore known variants lies in that, according to the present invention, each of the fingers can be moved separately and independently of each of the respective other finger. This requires two drives on each side rather than only one drive, as was previously used.

Generally, several variants are conceivable for driving the independently movable folding-in means of each pair of folding-in elements. It is for instance possible to arrange the shafts required for each movable folding-in means with their respectively allocated, separate drives one above the other, in each case aligned largely flush with each other. Optionally, the shafts with their respectively allocated, separate drives can be each arranged one above the other with parallel axes of rotation, said axes, however, shifted in relation to each other.

The present invention furthermore comprises folding-in means such as are used in particular in an apparatus according to one of the previously described embodiment variants, said folding-in means being part of an apparatus having the purpose of packaging articles in a box blank with folding lines and foldable flaps. The folding-in means are each bow-shaped so that an adequate clearance for each subsequent foldable flap of the successive boxes is created when said folding-in means move.

Finally, the invention comprises a method for packaging articles in a box blank with folding lines and foldable flaps, said method comprising at least the following steps: feeding a stream of articles, dividing up the articles into groups of articles, feeding a box blank to the group of articles and/or feeding the article stream to the box blank, and folding in the foldable flaps by means of at least one pair of folding-in means per rotating folding-in element. The method is characterized in that the two folding-in means are moved and/or controlled or regulated independently of one another. It is therefore preferably possible to use a separate drive for moving each one of the folding-in means. In particular, the folding-in means can thereby rotate about an axis that is perpendicular to the conveying plane. The folding-in means can additionally change the angle of their relative positions to each other during the process of folding in.

BRIEF DESCRIPTION OF THE DRAWINGS

In the following, the invention is described by means of exemplary embodiments with reference to the attached drawings. The figures illustrate and clarify exemplary embodiments of the present invention in its details and functions. The figures are presented for illustrative purposes and are not to be construed as restrictive.

DETAILED DESCRIPTION

Figure 1:
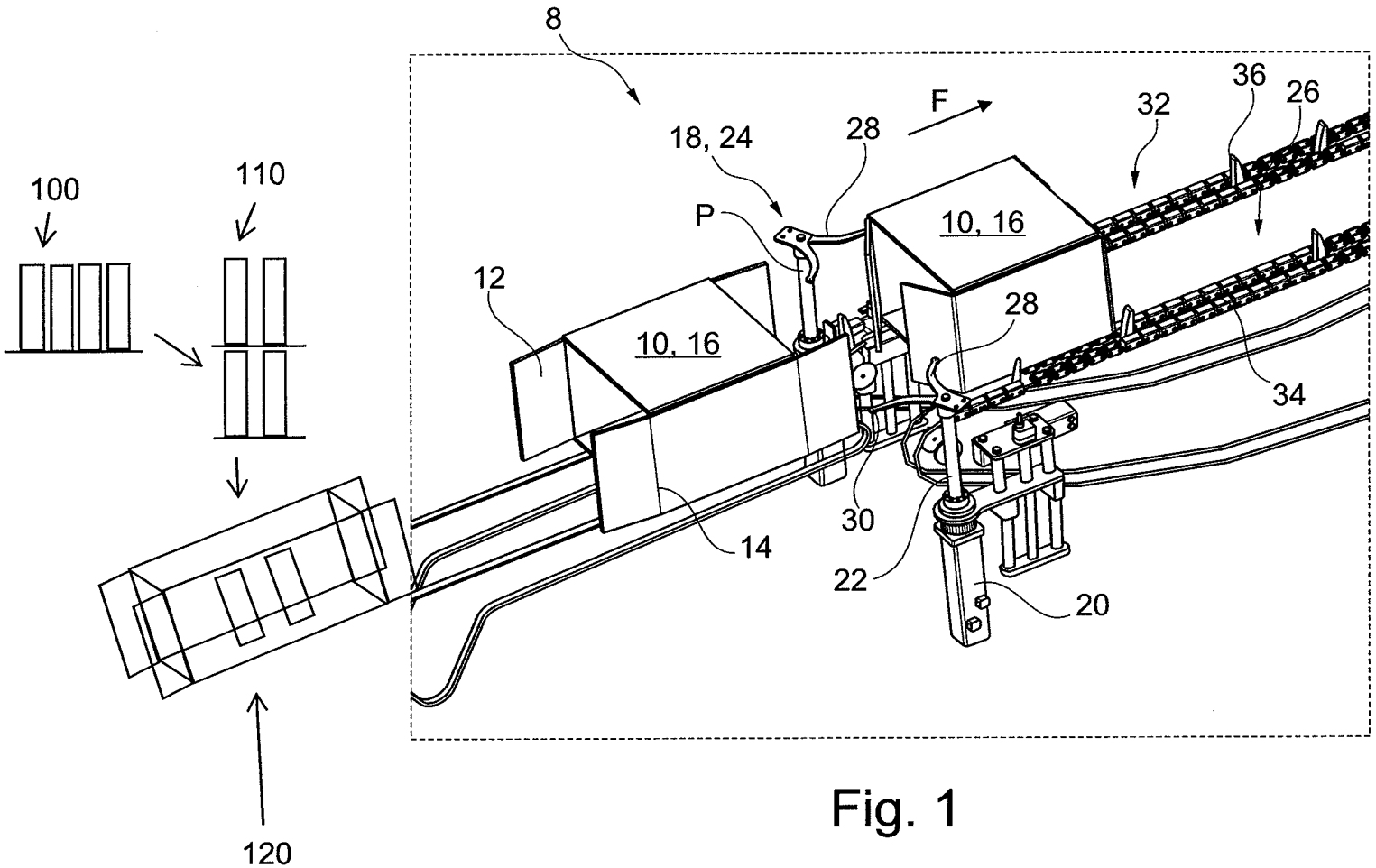
FIG. 1 shows a schematic perspective drawing of a first variant of an apparatus for folding in box blanks with articles therein.

The schematic perspective drawing in FIG. 1 shows a first variant of an apparatus for folding in box blanks with articles therein. In parts of its design, such an apparatus may resemble or correspond to the folding-in and packaging apparatus disclosed in DE 20 2005 014 345 U1. The box blanks 10 to be folded and sealed can comprise side flaps 12, lid flaps, and/or base flaps. For the sake of better clarity, only the side flaps 12 which have been vertically folded back along the folding lines 14 of the box blank 10 are illustrated in FIG. 1. Shown schematically are the device 100 for feeding a stream of articles, the device 110 for dividing up the articles into groups of articles, and the device 120 for feeding individual box blanks in the conveying direction to the groups of articles. The box blanks are typically transported in a continuous row from below to a position underneath the groups of articles in such a manner that the side flaps 12 point lengthwise in the conveying direction F. The illustrated apparatus 8 moreover comprises a device for forming a box 16 and for folding in the side flaps 12 transversely to the conveying direction F by means of folding-in elements 18, which rotate about an axis that is perpendicular to the conveying plane of the box blanks 10 or the boxes 16. The folding-in elements 18 each comprise a driving motor 20 with a perpendicular shaft 22 at the top end of which rod-shaped finger pairs 24 are arranged, said finger pairs 24 being aligned in each case pairwise and perpendicular to the vertical axis and therefore moving within a plane that is more or less parallel to the conveying plane 26. In the exemplary embodiment shown in FIG. 1, the finger pairs 24 are formed in such a manner that the fingers each extend bow-shaped within an essentially horizontal plane. The finger pairs 24 are furthermore arranged shifted in relation to each other, so that a first finger 28 folds in the side flap 12 at the rear end of a leading box 16 and a second finger 30 folds in the front side flap 12 of the subsequent box 16. In this first variant, the two fingers 28 and 30 of a finger pair are arranged positionally rigid relative to one another, enclosing a spread angle of approximately 90 degrees. The fingers 28 and 30 each have, however, bow-shaped curves with their convex sides facing each other so that the convex back sections of each bow-shaped, curved finger 28 and 30 are arranged in a wing-like manner. The spread or opening angle can optionally be approximately 90 degrees as in the illustrated example. Other opening angles are, however, also optionally possible.

The two folding-in means or fingers 28 and 30 are each bow-shaped so that a clearance P for each subsequent foldable flap 12 of a successive box 16 is created when said folding-in means move. With regard to freedom of movement for folding the flaps 12, the bow-shaped contour thus has a clear advantage.

FIG. 1 further shows a conveying device 32 which provides for the continuous transport of the box blanks 10 and the folded boxes 16 in the conveying direction F on the conveying plane 26. This conveying device can, for instance, comprise conveyor chains 34 with drive pins 36, the distances between which determine the spacing between consecutive boxes 16.

Figure 2:
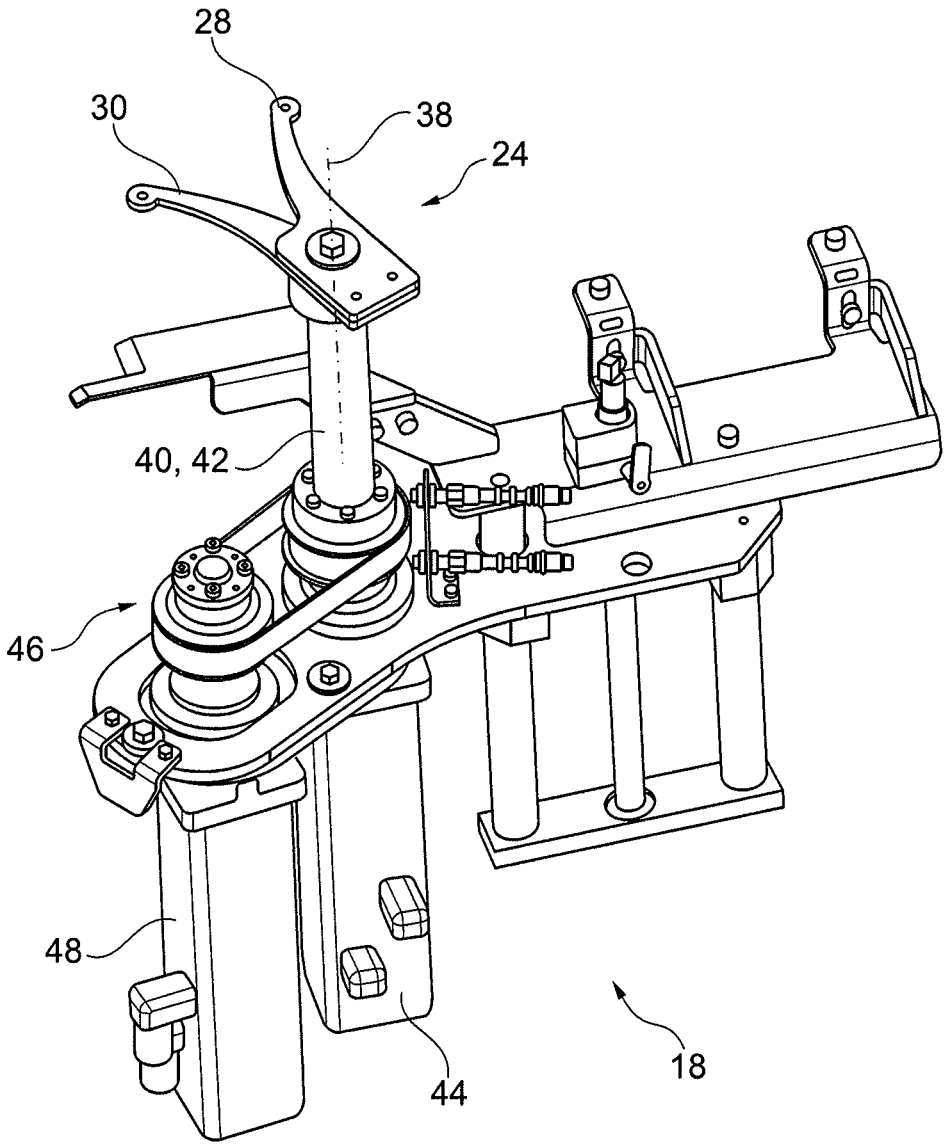
FIG. 2 shows a schematic perspective drawing of a folding-in apparatus according to the present invention.
Figure 3:
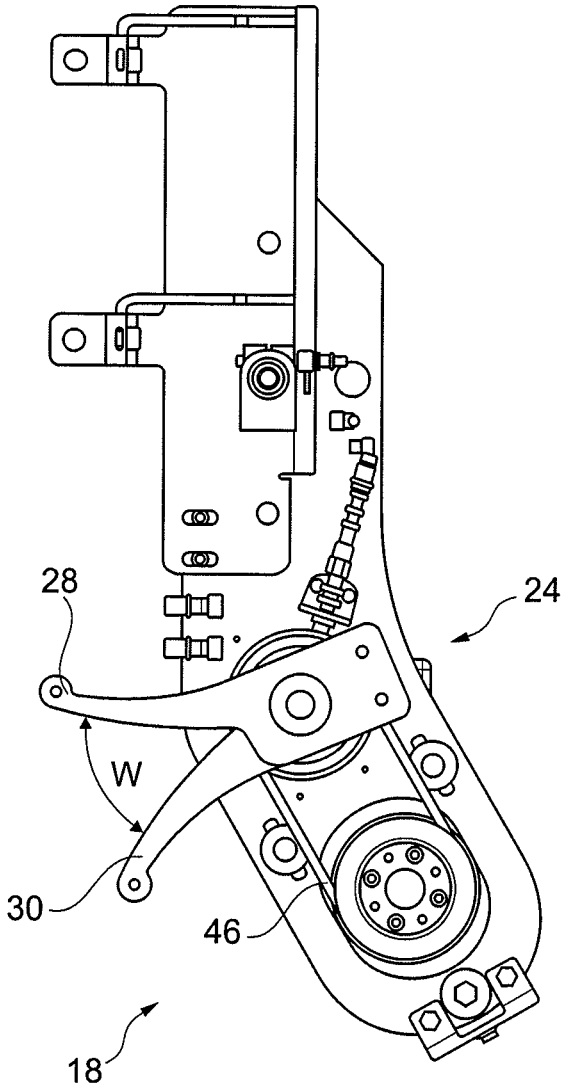
FIG. 3 shows a top view of the folding-in apparatus according to FIG. 2.
Figure 4:
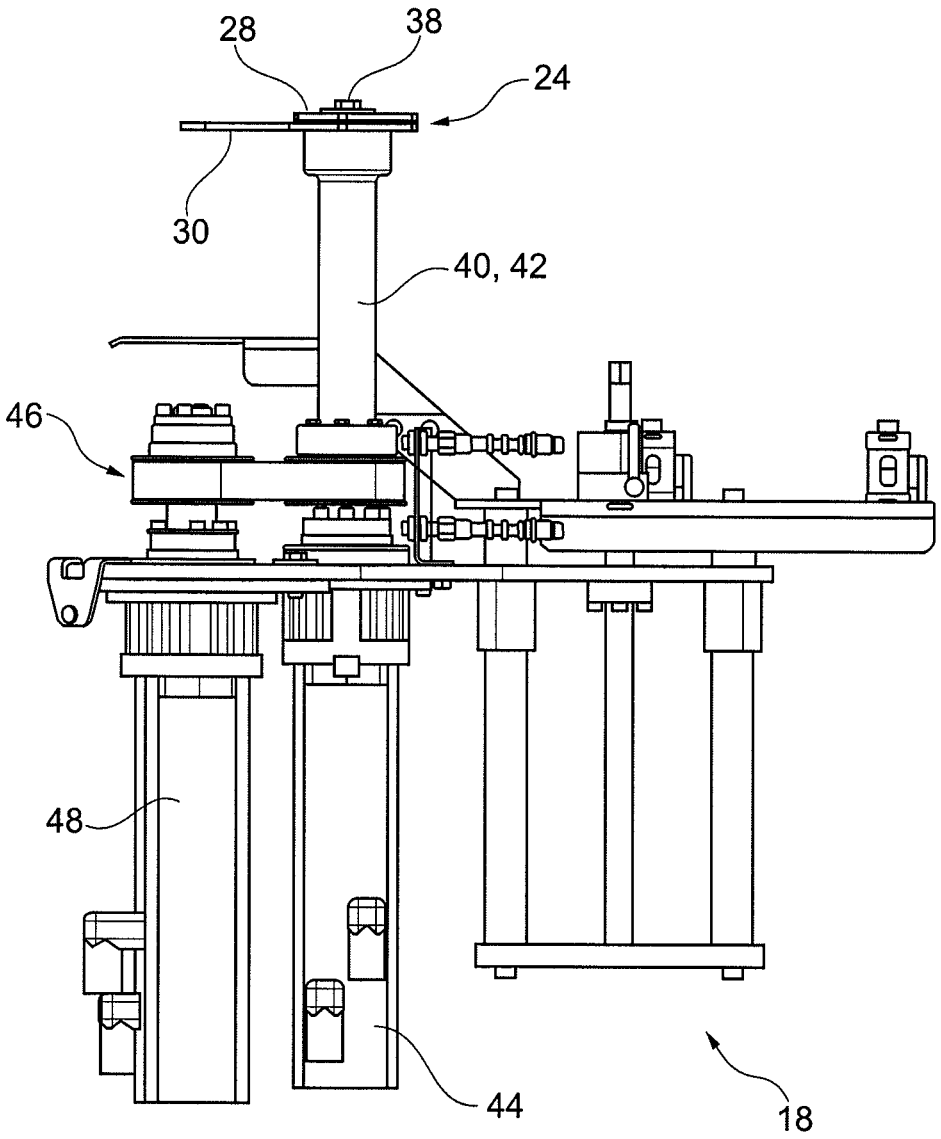
FIG. 4 shows a lateral view of the folding-in apparatus according to FIG. 2.

As can be seen from the schematic illustrations in the FIGS. 2 to 4, the present invention does not provide a rigid finger pair 24, but rather a first finger 28 and a second finger 30, with the fingers 28 and 30 being movable in relation to each other. The two fingers 28 and 30 are arranged within a more or less horizontal plane and they are moveable in relation to each other, which implies that they can perform rotary movements which are essentially independent of one another. Whereas the folding-in elements 18 known from prior art either have rigid finger pairs or could only be adjusted with regard to the angular position of the fingers in relation to each other and fixed in the selected positions in order to be able to perform the necessary rotating or pivoting movements, the exemplary embodiment according to the invention makes provisions for decoupling the rotating or pivoting movements of the two of the folding-in fingers 28 an 30, thus enabling smooth adjustments to different box sizes and pitch distances. The folding-in elements 18 serve for folding in box flaps 12 in a continuous conveying process in a packaging machine with the general features illustrated according to FIG. 1. This involves moving two separate fingers 28 and 30, which can be moved about a common axis of rotation 38 and by means of a combined, multi-part shaft 40.

As is moreover discernible from the exemplary embodiment shown in FIGS. 2 to 4, the rod-shaped fingers 28 and 30 are aligned in each case pairwise and more or less in perpendicular to a vertical plane or to a vertically arranged axis of rotation 38. They are furthermore arranged in the movement direction in positions shifted in relation to each other and movable about a common rotational axis 38. In order to realize this, the shaft 40 is designed as a multi-part hollow shaft 42 with shaft sections arranged coaxially in relation to each other and the fingers 28 and 30 disposed on each. Each of the shaft parts of the hollow shaft 42, on which the fingers 28 and 30 are each rigidly and, by means of the rotating shaft, pivotably arranged, has a drive of its own so that the shaft parts and the fingers 28 and 30 arranged thereon can each perform rotational movements independently of one another. Of the two shaft parts, only the outer hollow shaft 42 is visible, which has a torque-proof connection with the second finger 30. The inner shaft is identified schematically as 142 and at the front side it has a torque-proof connection with the first finger 28. While the concealed inner shaft is coupled to a first driving motor 44 by means of a rigid connection, i.e. by means of a direct drive, the outer hollow shaft 42 is coupled to a second driving motor 48 by means of a belt drive 46. The two driving motors 44 and 48 can be designed optionally as electric motor or as so-called fluidic drives, i.e. as pneumatic or hydraulic motors.

It is optionally possible to provide the finger-like folding-in elements 18 in variable and/or adjustable lengths. In this manner it is even better possible to set and adjust the apparatus 8 to different box and/or article sizes and different pitch distances.

Typically and according to FIG. 1, two pairs of finger-like folding-in elements 18, which are independently movable of each other, are each arranged on both sides of the article stream in such a manner that the side flaps 12 on both sides of the box blanks 10 can be folded in transversely to the conveying direction F. The essential improvement over the heretofore known variants lies in that, according to the present invention, each of the fingers 28 and 30 can be moved separately and independently of the respective other finger. This requires two drives 44 and 48 on each side rather than only one driving motor 20, as was previously used.

Further variants are conceivable, for instance without using hollow shafts, but rather shafts that are mounted independently of one another and that can be driven by separate motors. It is possible to drive one finger by means of a motor from below, for instance, and another finger on the opposite side by means of another motor from the top. Generally, several variants are conceivable for driving the independently movable folding-in means of each pair of folding-in elements. It is for instance possible to arrange the shafts required for each movable folding-in means with their respectively allocated, separate drives one above the other, in each case aligned largely flush with each other. Optionally, the shafts with their respectively allocated, separate drives can be each arranged one above the other with parallel axes of rotation, said axes, however, shifted in relation to each other.

LIST OF REFERENCE CHARACTERS

8 Apparatus for packaging articles
10 Box blank
12 Side flap
14 Vertical folding line
16 Box
18 Folding-in element
20 Driving motor
22 Shaft
24 Finger pair
26 Conveying plane
28 First finger
30 Second finger
32 Conveying device
34 Conveyor chain
36 Drive pin
38 Axis of rotation
40 Multi-part shaft
42 Hollow shaft
44 First driving motor
46 Belt drive
48 Second driving motor
100 Device for feeding a stream of articles
110 Device for dividing up the articles into groups of articles
120 Device 120 for feeding individual box blanks
F Conveying direction
P Clearance space
W Angle

What is claimed is:

1. An apparatus for packaging articles in a box blank having folding lines and at least one of side flaps, lid flaps and base flaps, the apparatus comprising:

a feed for feeding a stream of articles;

a divider for dividing up the articles into groups;

a box blank feed for feeding individual box blanks to the groups or for combining the groups and the box blanks, the box blank feed having a conveying direction and a conveying plane; and a former for forming a box and for folding in the side flaps using folding-in elements rotating about an axis perpendicular to the conveying plane or to the conveying direction, each of the folding-in elements comprising at least one pair of folding-in devices moved in a common plane, the two folding-in devices moved independently of one another and controlled or regulated independently of one another, the pair of folding-in devices including a first finger and a second finger, the first and second fingers each having bow-shaped curves with convex sides facing each other.

2. The apparatus as recited in claim 1 wherein the two folding-in devices are aligned in each case pairwise and perpendicular to a vertical and arranged in a movement direction in positions shifted in relation to each other and movable about a common rotational axis.

3. The apparatus as recited in claim 1 wherein the two folding-in devices include protruding rods.

4. The apparatus as recited in claim 1 wherein the folding-in devices are aligned in each case pairwise and perpendicular to a vertical and arranged in a movement direction in positions shifted in relation to each other and movable about rotational axes parallel to each other.

5. The apparatus as recited in claim 1 further comprising a first shaft connected to a first of the folding-in devices and a second shaft connected to a second of the folding-in devices, a first drive driving the first shaft and a second drive driving the second shaft.

6. The apparatus as recited in claim 5 wherein the first shaft and second shafts are coaxial inner and outer shafts.

7. The apparatus as recited in claim 5 wherein the first and second shafts are arranged vertically with respect to each other and in each case aligned flush with each other.

8. The apparatus as recited in claim 5 wherein the first and second shafts are each arranged vertically with respect to each other with parallel axes of rotation, the axes offset in relation to each other.

9. The apparatus as recited in claim 1 wherein the folding-in devices are variable and/or adjustable in length.

10. The apparatus as recited in claim 5 further comprising chain or belt drives directly coupling the first and second shafts to the first and second drive respectively.

11. The apparatus as recited in claim 1 wherein the common plane is horizontal.

12. The apparatus as recited in claim 1 wherein in each case two pairs of folding-in elements each movable independently of one another are arranged on both sides of the article stream, the elements used for folding in the side flaps of the box blanks transversely to the conveying direction.

13. A folding-in element for an apparatus for packaging articles in a box blank with folding lines and foldable flaps, the folding-in element comprising:

at least one pair of folding-in devices, the two folding-in devices being moved independently of one another and controlled or regulated independently of one another, each folding-in device being bow-shaped so that a clearance for each subsequent foldable flap is created when the folding-in devices move, the pair of folding-in devices including a first finger and a second finger, the first and second fingers each having bow-shaped curves with convex sides facing each other.

14. A method for packaging articles in a box blank having folding lines and foldable side flaps, the method comprising at least the following steps:

feeding a stream of articles, dividing up the articles into groups of the articles, feeding a box blank to one of the groups of the articles and/or combining the group of the articles and the box blank, folding in the foldable flaps using at least one pair of folding-in devices of a rotating folding-in element, the two folding-in devices of the pair being moved independently of one another and controlled or regulated independently of one another; and decoupling a rotating or pivoting movement of a first of the two folding-in devices with respect to a second of the two folding-in devices.

15. The method as recited in claim 14 wherein a separate drive is used for moving each one of the folding-in devices.

16. The method as recited in claim 14 wherein the folding-in devices rotate about an axis perpendicular to a conveying plane.

17. The method as recited in claim 14 wherein the folding-in devices change an angle of their relative positions with respect to each other during the process of folding in.

18. The method as recited in claim 14 wherein the decoupling step enables an adjustment to a different box size or pitch distance.

* * * * *